United States Patent [19]

Zimmerman et al.

[11] 4,281,517

[45] Aug. 4, 1981

[54] SINGLE STAGE TWIN PISTON CRYOGENIC REFRIGERATOR

[75] Inventors: James E. Zimmerman; Donald B. Sullivan, both of Boulder, Colo.

[73] Assignee: The United States of America as represented by the Secretary of the Navy, Washington, D.C.

[21] Appl. No.: 125,005

[22] Filed: Feb. 27, 1980

[51] Int. Cl.[3] ..... F25B 9/00

[52] U.S. Cl. ..... 62/6

[58] Field of Search ..... 62/6

[56] References Cited

U.S. PATENT DOCUMENTS

| | | | |
|---|---|---|---|
| 3,969,907 | 7/1976 | Doody | 62/6 |
| 3,971,230 | 7/1976 | Fletcher | 62/6 |
| 3,991,585 | 11/1976 | Mulder | 62/6 |
| 4,036,027 | 7/1977 | Bamberg | 62/6 |
| 4,090,858 | 5/1978 | Hanson | 62/6 |
| 4,090,859 | 5/1978 | Hanson | 62/6 |
| 4,143,520 | 3/1979 | Zimmerman | 62/6 |
| 4,235,078 | 11/1980 | Morbidi | 62/6 |
| 4,244,192 | 1/1981 | Chellis | 62/6 |

*Primary Examiner*—Ronald C. Capossela
*Attorney, Agent, or Firm*—R. S. Sciascia; Sol Sheinrein; Kenneth E. Walden

[57] ABSTRACT

A single stage, twin piston cryogenic refrigerator for cooling superconducting devices. The refrigerator uses helium as the heat transfer medium and is constructed with two nested, concentric pistons, an inner piston and an outer piston, mounted in a cylinder and driven 90° out of phase by a common crankshaft. The inner piston extends through and below the outer piston and is received in a stationary insert mounted in the cylinder. The outer piston has a first piston face which forms a compression space with the stationary insert while the inner piston has a second piston face which forms an expansion space with the cylinder and the insert. The inner piston is formed with upper and lower piston halves joined by a flexible joint positioned in the compression space. Cylindrical regenerator gaps are present at the interface of the inner piston with the stationary insert and at the interface of the stationary insert with the cylinder.

25 Claims, 7 Drawing Figures

SINGLE STAGE TWIN PISTON CRYOGENIC REFRIGERATOR

BACKGROUND OF THE INVENTION

The present invention relates to a cryogenic refrigerator for cooling superconducting devices, and more particularly to a single stage, twin piston refrigerator for prolonged, low power cooling.

With the advent of superconducting quantum interference devices, a number of electronic instruments have been developed which are vastly superior to their conventional components in terms of sensitivity, operating speed and portability. These devices require a low temperature environment below 9° to 10° K. and preferably 3° to 7° K. for optimum performance. This low temperature environment is attained by the use of helium cryocoolers.

Prior art cryogenic refrigerators include the four stage cascade displacer and cylinder of Zimmerman, U.S. Pat. No. 4,143,520, which can attain a temperature on the order of 8.5° to 13° K. The cascaded nylon displacer of Zimmerman is annealed into precise conformation with the epoxy-glass composite cylinder to form optimum clearances upon cooling and thus enabling the low temperatures to be achieved.

The main limitation on the cold end temperature of this machine is the heat regenerative capacity. The total regenerator heat capacity of the final stage, compared to that of the working fluid, is too small to provide efficient regenerative heat exchange.

To obtain temperatures lower than that permitted by the Zimmerman cryogenic refrigerator, it is necessary to provide more efficient regenerative heat exchange between the displacer and the working fluid.

SUMMARY OF THE INVENTION

Accordingly, in the present invention there is provided a single stage, twin piston cryogenic refrigerator which provides more efficient regenerative heat exchange between a displacer and a working fluid.

The refrigerator uses helium as a working fluid or heat transfer medium at subatmospheric average pressure. The cold parts of the refrigerator are two nested, concentric pistons, an inner piston and an outer piston, mounted in a stationary outer cylinder. The pistons are driven 90° out of phase by connecting rods and a crankshaft powered with an electric motor.

The inner piston extends through and below the outer piston and is received in a stationary insert mounted in the cylinder. The outer piston is provided with a first piston face which forms a compression space with the cylinder and an upper face of the stationary insert. The inner piston is provided with a second piston face which forms an expansion space with the stationary insert and a bottom surface of the cylinder.

The inner piston is formed with upper and lower piston halves joined by a flexible joint positioned in the compression space. Cylindrical regenerator gaps are present at the interface of the inner piston with the stationary insert and at the interface of the stationary insert with the cylinder.

OBJECTS OF THE INVENTION

It is therfore an object of the present invention to provide a low-power, single stage, twin piston cryogenic refrigerator.

Another object of the invention is to provide a cryogenic refrigerator which liquefies the heat transfer medium at the cold end of the machine.

Another object of the invention is to provide a single stage, twin piston cryogenic refrigerator which produces several milliwatts of refrigeration at temperature ranges of 3° to 4° K.

Yet another object of the invention is to provide a single stage, twin piston cryogenic refrigerator with efficient regenerative heat exchange.

A further object of the invention is to provide a refrigerator which can be used as the final stage of a small helium liquefier or cryocooler such as a Stirling, Viulleumier or Gifford-McMahon cycle machine.

Other objects, advantages and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by reference to the following detailed description when considered with the accompanying drawings in which like reference numerals designate like parts throughout the figures and wherein.

DESCRIPTION OF THE PREFERRED EMBODIMENT

Figure 1:
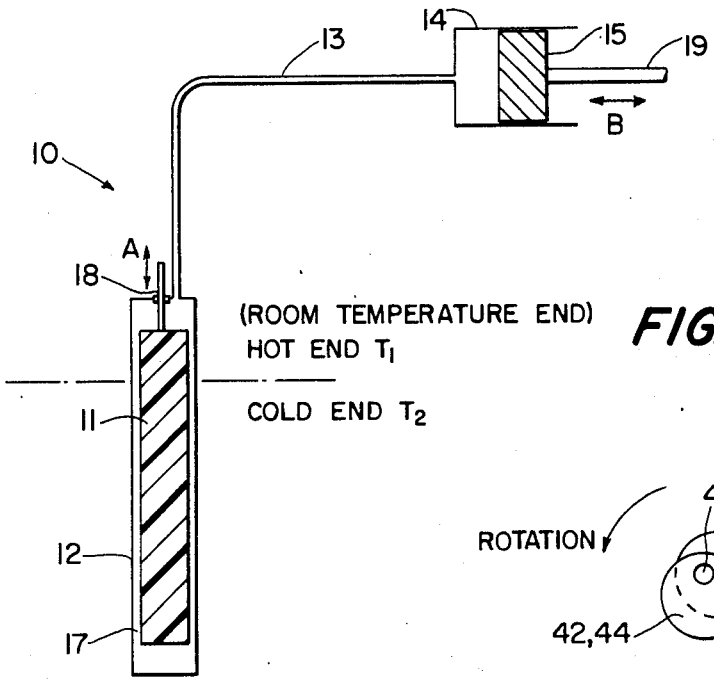
FIG. 1 is a schematic representation of a split Stirling cycle machine.

Referring to FIG. 1, there is shown in schematic form a split Stirling cycle refrigeration machine or system 10 which includes a displacer 11 mounted in a displacer cylinder 12. The displacer is moved in a reciprocating manner by rod 18, as shown by arrow A. A fluid line 13 connects cylinder 12 to a piston chamber 14 in which piston 15 is positioned. A working fluid, such as helium gas, is present in displacer cylinder 12, fluid line 13 and piston chamber 14. Displacer 11 fits loosely in cylinder 12 to form a cylindrical regenerative gap 17 so that the gas present in the system can move freely past it, resulting in approximately equal pressure throughout the system. Work may be done on the system as piston 15 changes the volume of the system by moving in a reciprocating fashion, as indicated by arrow B, but no work is done by displacer 11 because the displacer does not change the volume of the system.

Figure 2:
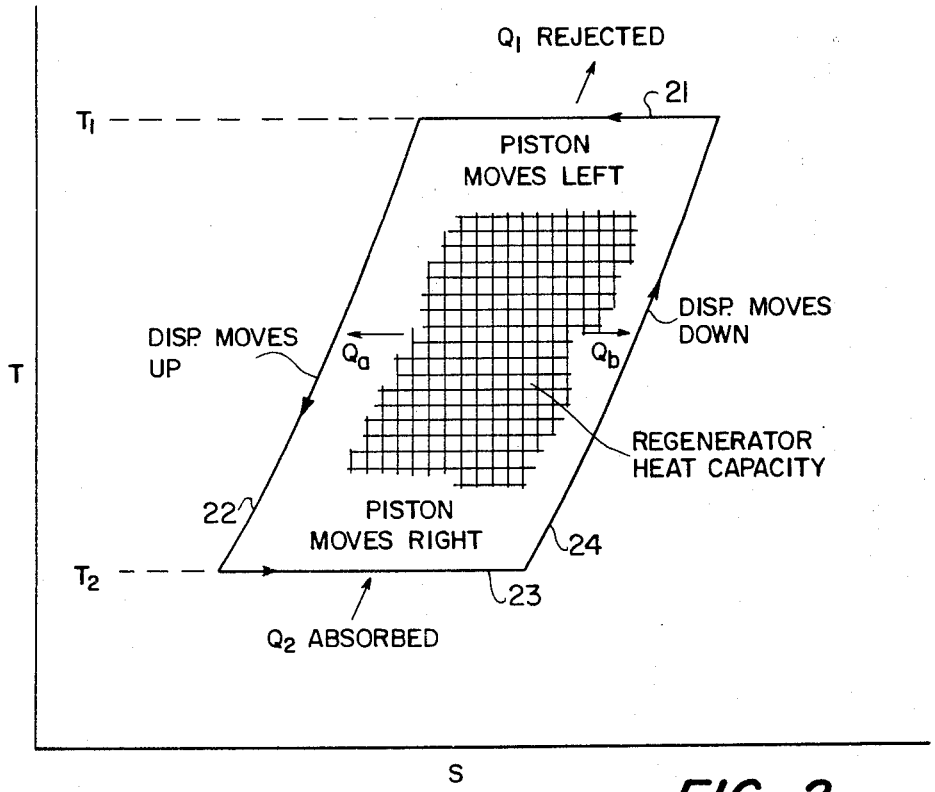
FIG. 2 is a graphical representation of an idealized thermo-dynamic cycle of the machine of FIG. 1 on a temperature-entropy diagram.

Referring to FIG. 2, there is shown an idealized thermodynamic cycle for the split Stirling cycle machine shown in FIG. 1. When displacer 11 is in its lowest position, piston 15 is moved to the left in cylinder 14 to compress the working fluid, which may be helium gas or equivalent fluid, to produce a heat of compression $Q_1$ which is rejected at ambient pressure and ambient temperature $T_1$, typically 300° K., as indicated at 21.

Displacer 11 is then moved to the top of displacer cylinder 12, displacing the working fluid from the top to the bottom of the displacer cylinder. Assuming that the machine is already in steady-state operation, with the bottom end of the displacer at low temperature $T_2$, and a stable temperature gradient along the displacer, then the fluid being displaced in cylinder 12 gives up heat $Q_a$ to the displacer and the displacer cylinder wall along regenerator gap 17, as indicated in FIG. 2 at 22. The working fluid thus arrives as the bottom end of the displacer at temperature $T_2$.

Piston 15 is then moved to the right of the cylinder 14, permitting the working fluid to expand and produce a flow of heat $Q_2$ into the fluid at temperature $T_2$, as indicated in FIG. 2 at 23. Finally, displacer 11 is moved back to its lowest position in displacer cylinder 12, displacing the remainder of the fluid back to the top of the cylinder and completing the cycle. The fluid picks up heat $Q_b$ from the walls of regenerative gap 17 as it travels from the bottom of the displacer to the top of the displacer and changes in temperature from $T_2$ to $T_1$, as shown in FIG. 2 at 24.

In steady state operation it is required that $Q_a=Q_b$, otherwise the temperature gradient along the regenerative gap will change with time, as in the initial operation of the machine, to reach $T_2$. With real gases, as opposed to theoretical gases, such as helium at 20° K. and below, the requirement $Q_a=Q_b$ isincompatible with the assumption of isothermal heat exchange $Q_1$ and $Q_2$ at $T_1$ and $T_2$ because the enthalpy change $Q_a$ or $Q_b$ between $T_1$ and $T_2$ depends on pressure so that the expansion cannot be strictly isothermal. This is a limitation on Stirling cycle machines.

A more serious limitation, which the present invention is concerned with, is that the heat capacity of the displacer and displacer cylinder walls, forming the regenerative gap on the cold end, becomes insufficient, relative to the heat capacity of the working fluid, to efficiently provide the necessary heat exchange $Q_a$ and $Q_b$.

Figure 3:
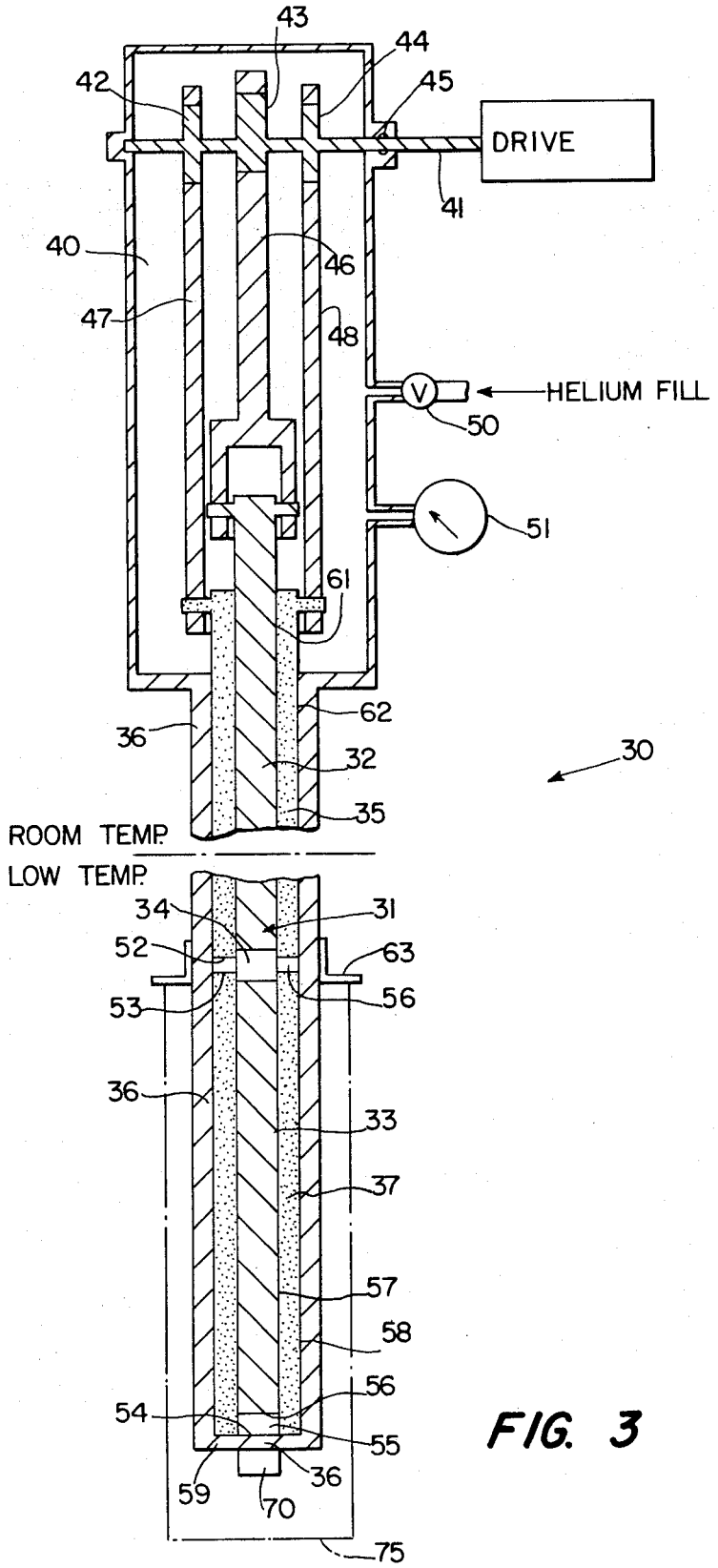
FIG. 3 is a schematic representation of a preferred embodiment of the present invention in a Stirling cycle machine.

Referring to FIG. 3 there is illustrated a schematic cross-section of a single stage, twin piston cryogenic regrigerator 30 which provides more efficient heat exchange between both the displacer and displacer cylinder and the working fluid. Refrigerator 30 is constructed with an inner piston 31 mounted for reciprocating motion in an outer piston 35. The outer piston is mounted for reciprocating motion in cylinder 36.

Inner piston 31 is provided with an upper piston half 32 and a lower piston half 33 connected by flexible joint 34 which may be a universal joint or equivalent connection. The inner piston projects through and below the outer piston such that the inner lower piston half extends into a stationary insert 37 which is positioned in cylinder 36. Flexible joint 34 permits lower piston half 33 to center itself in stationary insert 37 and thus prevent misalignment and the associated frictional heating.

As illustrated in FIG. 3, cylinder 36 is provided with an upper chamber 40 in which is mounted crankshaft 41 having crankthrows 42–44. The upper chamber is provided with valve 50 for filling the chamber and cylinder with working fluid, such as helium gas or other equivalent fluid, and a pressure gauge 51 for monitoring the pressure of the fluid.

Figure 4:
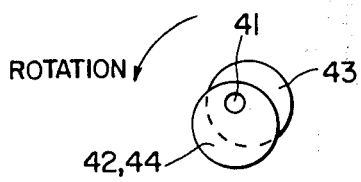
FIG. 4 is a schematic representation of the crankshaft phasing in the present invention.

FIG. 4 illustrates the relationship of crankthrow 43 to crankthrows 42 and 44 as being 90° out of phase and behind crankthrow 42 and 44 for clockwise rotation. Crankshaft 41 is mounted in chamber 40 and sealed to prevent fluid leakage by O-ring 45. The crankshaft may be driven by an electric motor or other suitable drive means and is drivingly connected from crankthrow 43 to inner piston 31 by connecting rod 46. Connecting rods 47 and 48 drivingly connect crankthrows 42 and 44, respectively, with the outer piston. Although the drive means is illustrated as mounted outside chamber 40, it is contemplated that the drive means could be mounted in chamber 40.

Figure 6:
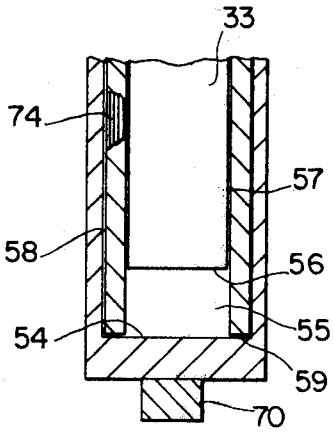
FIG. 6 shows an enlarged cross-section of the cold end of the machine.
Figure 7:
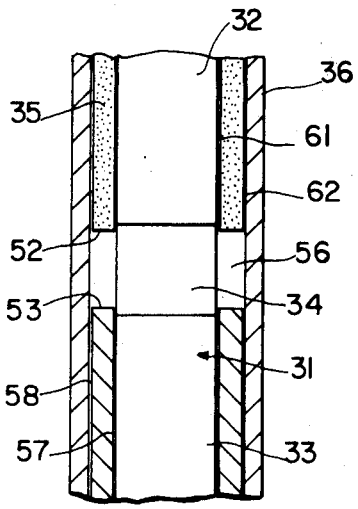
FIG. 7 shows an enlarged cross-section of the compression portion of the machine.

Referring to FIGS. 3, 6 and 7, a compression space 56 is formed between a first piston face 52 of outer piston 35 and an upper face 53 of stationary insert 37, as shown in FIG. 7. An expansion space 55 is formed between a second piston face 56 of lower piston half 33 and cylinder bottom 54, as shown in FIG. 6. Cylindrical regenerator gaps 57 and 58 are formed below compression space 56 by clearance between cylinder 36, stationary insert 37, and inner piston 31 at the cylindrical interfaces of these elements. Regenerative gap 57 lies between the inner piston and the stationary insert while gap 58 lies between the stationary insert and the cylinder. Regenerative gaps 57 and 58 extend above compression space 56 as clearance gaps 61 and 62, respectively. An end gap 59, provides communication of regenerative gap 58 with expansion space 55. The parallel cylindrical regenerative gaps 57 and 58, separated by stationary insert 37, give approximately three times the regenerative heat exchange area, compared to a single gap, and thus three times the regenerative heat capacity of a single gap. It is contemplated that insert 37 can have a plurality of regenerative gaps formed in the insert in addition to gaps 57 and 58, as shown at 74 in FIG. 6. It is also contemplated that the gaps may be formed by a series of thin-walled concentric inserts (not shown).

Inner piston 31, outer piston 35, cylinder 36, and stationary insert 37 are made of commercially available metal, plastic compound, spun-glass epoxy, glass or similar material which has the required mechanical and thermal properties. It is contemplated that the inner or outer pistons can be constructed of nylon or similar material that forms the proper size regenerative gaps upon annealing. The insert can also be constructed of material having a high heat capacity, such as thallium chloride and various rare earth compounds, for more efficient regenerative heat exchange. The insert can also have incorporated therein material providing large transverse thermal conductivity such as fine aluminum wires.

The working fluid used in the refrigerator is helium at subatmospheric pressure. During operation, several cubic millimeters of liquid helium are formed in expansion space 55 at the cold end and are present throughout the operating cycle.

Owing to the reduced viscosity of helium at low temperature, there is little pressure drop across regenerator gaps 57 and 58 resulting in essentially equal pressure in compression space 56 and expansion space 55. The large length-to-width ratios of clearance gaps 61 and 62 prevent significant gas leakage between the pistons and chamber 40 at the room temperature end of the machine at the operating speeds. However, since th ere are no sliding seals on the pistons the average pressure in cylinder 36 is identical to the pressure in chamber 40.

As shown in FIG. 3, it is contemplated that a superconducting device 70 can be attached to the cylinder cold end with the cold end positioned in a vacuum container 75. The vacuum container can be provided with inner and outer radiation shields (not shown).

For experimentation, a flange 63 is mounted on the cylinder outer surface adjacent compression space 56. The flange is maintained at a temperature range of 8° to 14° K. by an electric heater mounted on the flange (not shown) and by means of a weak thermal link to a liquid helium bath (not shown). The temperature of the hot flange is controlled by varying the heater power. The boil off rate of the helium bath is used as a measure of the heat absorbed at the cold end. Changes in the boil off rate of the helium bath can be used to estimate the heat given off from the hot end of the refrigerator during operation.

During operation of the disclosed refrigerator at steady-state conditions, with helium as the working medium, crankthrow 43, driven by crankshaft 41, moves connecting rod 46 and thus inner piston 31 to its lowest position in cylinder 36. At approximately 90° of crankshaft travel later, crankthrows 42 and 44 drive outer piston 35 down to compress the helium gas in compression space 56 producing a heat of compression which is rejected at ambient temperature $T_1$.

As the crankshaft and crankthrows continue their travel, inner piston 31 is moved to its highest position creating expansion space 55 at the cold end. The compressed helium gas flows through regenerative gaps 57 and 58 to expansion space 55 and gives up heat to the inner piston, stationary insert and cylinder, arriving at expansion space 55 at a lower temperature $T_2$.

When the outer piston is raised, 90° later in the cycle, the compressive force on the gas is released and the gas can expand in expansion space 55 and absorb heat from the interior of vacuum container 75 in which the cold end of cylinder 36 is positioned. As the crankshaft continues its cycle, the inner piston is returned to its lowest position in the cylinder and the working fluid flows through regenerative gaps 57 and 58 to compression space 56 for the completion of the cycle.

The presence of liquid helium in the cold end during operation indicates that the operating temperature at the average pressure is essentially the temperature at equilibrium vapor pressure. In operation, 3.1° K. was achieved with an average pressure of 0.027 MPa, and 4.0° K. with an average pressure of 0.08 MPa. The hot end temperatures were 8.6° K. and 12° K., respectively. The machine tested hot a hot end of 1 m in length, a cold end of 12 cm, a piston stroke of 1 cm at 1 Hz. and regenerative gaps of ~30 μm width.

With the upper end temperature at 8.7° K., the refrigerator maintained a temperature of 4° K. at an operating pressure of 0.08 MPa. There is some reserve cooling capacity present but the operating temperature is limited by the pressure of the liquid phase. Heat was added at the cold end to determine the reserve cooling capacity. The system maintained liquid helium at 4.0° K. up to a heat input of 4 mW at which point the system reverted to single phase gas operation. At 9 mW input power the temperature rose to 5.5 K. The Carnot coefficient for the cooler is $4/(8.7-4)=0.85$. From changes in the helium boil-off rate, we estimated that the heat ejected at the hot end is about 50 mW. Thus the actual refrigeration of 4 mW at 4° K. is a reasonable fraction of the theoretical cooling power ($50\ \text{mW}\times 0.85=42\ \text{mW}$).

Figure 5:
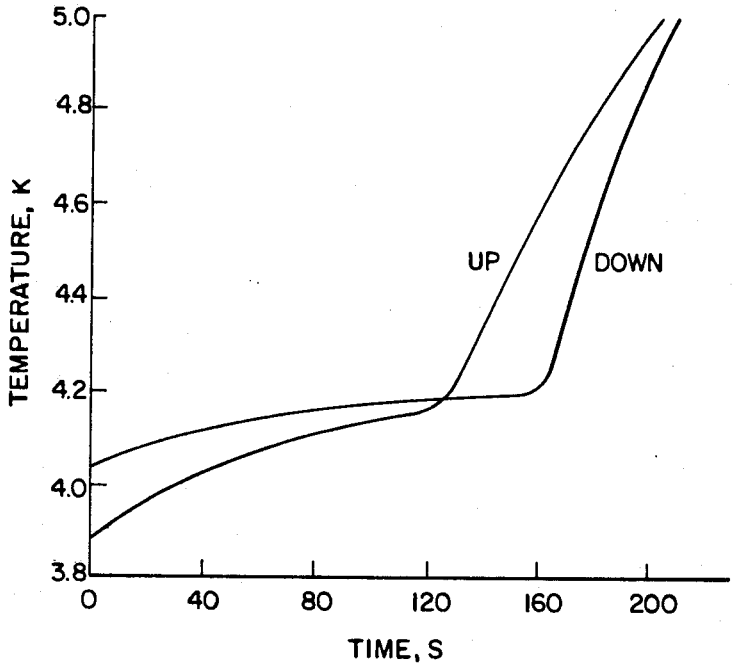
FIG. 5 shows warming curves for the cold end of the refrigerator.

FIG. 5 shows two separate warming curves for the cold end of the refrigerator recorded immediately after the drive motor was switched off. This demonstrates the presence of liquid helium in the system. The temperature rises gradually at first since the evaporation of the liquid increases the overall system pressure. After several minutes the temperature increases more rapidly, indicating evaporation of the last bit of liquid. The total quantity of liquid helium present in the system can be estimated from the pressure change during the slow portion of warm-up of the cold end and comes out to be ~0.02 $cm^3$. The time interval required for all the liquid to evaporate varies because a different quantity of liquid is present during each part of the cycle. The variation in slope beyond the break point indicates different heat capacities at the cold end, that is, if the inner piston is in its uppermost position then the heat capacity of the extra vapor reduces the warming rate. This is a clear indication that the heat capacity of the vapor in the expansion space is significantly greater than that of the glass-epoxy, the implication being that the additional channel for regenerative heat exchange provided by the stationary insert and the additional regenerative gap 58 significantly increases the regenerative heat capacity of the refrigerator.

Although the refrigerator of the subject invention is disclosed as a Stirling cycle machine, it is contemplated that the invention can be used as the final stage in either a Vuilleumier or Gifford-McMahon machine or as a complement to the Zimmerman multi-stage cascade machine. If used as a complement, the twin piston machine is either positioned with its hot end attached to the cold end of the multi-stage machine or positioned in the multi-stage machine as a final stage.

It is apparent that the disclosed low power, single stage, twin piston refrigerator provides for several milliwatts of refrigeration at 3° to 4° K. by increasing regenerative heat exchange. The refrigerator liquefies the heat transfer medium at the cold end of the machine and can be used as the final stage in a small cryocooler such as a Stirling, Vuilleumier or Gifford-McMahon cycle machine.

Obviously, many modifications and embodiments of the specific invention, other than those set forth above, will readily come to mind to one skilled in the art having the benefit of the teachings presented in the foregoing description and the accompanying drawings of the subject invention and hence it is to be understood that the invention is not limited thereto and that such modifications are intended to be included within the scope of the appended claims.

What is claimed is:

1. A regenerative cycle refrigerator with a working fluid comprising:

a cylinder;

means compressing the working fluid in the cylinder;

means expanding the working fluid in the cylinder;

means driving the compressing means and expanding means; and means forming a plurality of regenerative heat exchange paths between the compressing means and the expanding means.

2. A refrigerator as in claim 1 wherein the means compressing the working fluid comprise a first piston positioned in the cylinder, said first piston being hollow.

3. A refrigerator as in claim 2 wherein the means expanding the working fluid comprise a second piston, said second piston being positioned in the first piston to extend through the first piston and into the cylinder.

4. A refrigerator as in claim 3 wherein the means forming the regenerative heat exchange paths comprise gap means positioned between the cylinder and the second piston to increase the regenerative heat capacity of the refrigerator.

5. A refrigerator as in claim 4 wherein the working fluid is a gas.

6. A refrigerator as in claim 5 wherein the means compressing the working fluid further comprise a compression space positioned between the first piston and the gap means.

7. A refrigerator as in claim 6 wherein the means expanding the working fluid further comprise an expansion space positioned between the second piston, the gap means and the cylinder.

8. A refrigerator as in claim 7 wherein the cylinder is mounted in a vacuum chamber.

9. A refrigerator as in claim 8 wherein a superconducting device is attached to the cylinder.

10. A refrigerator as in claim 3 wherein the second piston comprises:

an upper piston half;

a lower piston half; and a flexible joint connecting the upper piston half and the lower piston half.

11. A refrigerator as in claim 1 wherein the working fluid is helium.

12. A refrigerator as in claim 1 wherein the means forming the plurality of regenerative heat exchange paths comprise gap means positioned between the expanding means and the cylinder so as to increase the regenerative heat capacity of the refrigerator.

13. A refrigerator as in claim 4 or 12 wherein said gap means is an insert means positioned between the cylinder and the expanding means.

14. A refrigerator as in claim 13 wherein the gap means are formed in the insert means.

15. A refrigerator as in claim 1 wherein the driving means comprise:

a crankshaft in the cylinder;

means for rotating the crankshaft;

first means connecting the crankshaft to the first piston;

second means connecting the crankshaft to the second piston; and means sealing the crankshaft with the cylinder.

16. A method of refrigeration using a working fluid in a cylinder in a regenerative heat exchange cycle comprising:

compressing the working fluid in a compression space and removing the heat of compression;

transferring the working fluid through a plurality of regenerative heat exchange gaps to an expansion space;

decompressing the working fluid;

expanding the working fluid to absorb the heat of expansion; and transferring the working fluid back into the compression space through the plurality of regenerative heat exchange gaps to remove the heat of expansion.

17. A method of refrigeration as in claim 16 wherein the working fluid is helium and liquid helium is formed in the expansion space during the refrigeration cycle from the increased heat exchange created by the plurality of gaps.

18. A refrigerator as in claim 17 wherein an insert is positioned in the cylinder and the gaps are formed by the insert.

19. A refrigerator as in claim 18 wherein the gaps are formed in the insert.

20. A method of refrigeration as in claim 16 wherein the working fluid is compressed in a compression space by a first hollow piston.

21. A method of refrigeration as in claim 20 wherein the working fluid is transferred through the gaps by a second piston mounted in the first piston.

22. A method of refrigeration using a working fluid in a cylinder having a first hollow piston in the cylinder, a second piston in the first piston and projecting into the cylinder, a gap means between the second piston and the cylinder, a compression space between the first piston and the gap means, an expansion space between the second piston, the gap means and the cylinder, a plurality of regenerative heat exchange gaps formed between the second piston and the cylinder, and means driving the first piston and the second piston, comprising the steps of:

compressing the working fluid in the compression space with the first piston;

removing the heat of compression;

transferring the working fluid to the expansion space through the plurality of regenerative heat exchange gaps by moving the second piston out of the expansion space;

decompressing the working fluid with the first piston;

expanding the working fluid to absorb the heat of expansion; and transferring the working fluid back into the compression space through the plurality of regenerative heat exchange gaps to remove the heat of expansion by moving the second piston back into the expansion space.

23. A method of refrigeration as in claim 22 wherein the working fluid is helium and liquid helium is formed in the expansion space during the refrigeration cycle from the increased heat exchange created by the plurality of gaps.

24. A method of refrigeration as in claim 22 or 23 wherein an insert is positioned in the cylinder and the gaps are formed between the insert and the second piston and the insert and the cylinder.

25. A refrigerator as in claim 24 wherein the gaps are formed in the insert.

* * * * *